US008567787B1

(12) United States Patent
Chang

(10) Patent No.: US 8,567,787 B1
(45) Date of Patent: Oct. 29, 2013

(54) WORD SCRAMBLE GAMES FOR STIMULATING BRAIN AND PHYSICAL HEALTH

(75) Inventor: Ifay Fay Chang, Katonah, NY (US)

(73) Assignee: Ifay F. Chang, Katonah, NY (US)

( * ) Notice: Subject to any disclaimer, the term of this patent is extended or adjusted under 35 U.S.C. 154(b) by 0 days.

(21) Appl. No.: 10/331,092

(22) Filed: Dec. 30, 2002

(51) Int. Cl.
*A63F 3/00* (2006.01)

(52) U.S. Cl.
USPC ..... 273/299; 273/300; 273/302; 434/171

(58) Field of Classification Search
USPC ..... 273/272, 299, 301, 302, 307; 434/129, 434/159, 161, 167, 171, 172, 176
See application file for complete search history.

(56) References Cited

U.S. PATENT DOCUMENTS

| | | | | |
|---|---|---|---|---|
| 1,036,166 | A * | 8/1912 | Trusty | 273/307 |
| 1,485,146 | A * | 2/1924 | Mundell | 273/296 |
| 2,562,633 | A * | 7/1951 | Needham | 273/307 |
| 4,004,811 | A | 1/1977 | Brandin | |
| 4,341,387 | A * | 7/1982 | Freyman | 273/240 |
| 4,877,355 | A | 10/1989 | von Braunhut | |
| 4,934,711 | A * | 6/1990 | Runstein | 273/272 |
| 5,033,754 | A * | 7/1991 | Finch | 273/299 |
| 5,044,996 | A | 9/1991 | von Braunhut | |
| 5,242,171 | A * | 9/1993 | Hata | 273/292 |
| 5,393,062 | A | 2/1995 | Cember | |
| 5,409,237 | A | 4/1995 | Marcley | |
| 5,520,394 | A * | 5/1996 | Brueckner | 273/272 |
| 5,615,886 | A * | 4/1997 | Chalfin et al. | 273/272 |
| 5,769,421 | A | 6/1998 | Wakefield | |
| 6,234,486 | B1 * | 5/2001 | Wallice | 273/299 |
| 6,276,940 | B1 * | 8/2001 | White | 434/172 |
| 6,279,911 | B1 | 8/2001 | Cherry | |
| 6,367,798 | B1 | 4/2002 | Lawal | |
| 6,378,868 | B1 * | 4/2002 | La Bossiere | 273/272 |
| 6,422,562 | B1 | 7/2002 | Daniel | |
| 6,446,967 | B1 * | 9/2002 | Jamali | 273/236 |

OTHER PUBLICATIONS

Ex.Parte Breslow 192 USPQ 431.*

* cited by examiner

*Primary Examiner* — Vishu K. Mendiratta

(57) ABSTRACT

A word game system for playing multiple word games and its corresponding play methods are disclosed. The game system and the multiple word games are all based on the word scramble process—constantly and dynamically scrambling the playing pieces to form words by all the players all the time, hence extremely stimulating and entertaining. The game system and its specific set of playing pieces with proper ranking distribution, value point assignments, math function selections and incorporation of wild playing pieces support a host of brain stimulating games including Scramble Word, Scramble Poker and Scramble Ma-Jong. These word games are playable in English and other languages and playable as board, computer, broadcasting as well as board-less games.

12 Claims, 10 Drawing Sheets

Scramble Game System and Components

100 illustration of the Scramble game system and components (not all components are necessary in all of 'Scrammble Games'.

Scramble Game System and Components
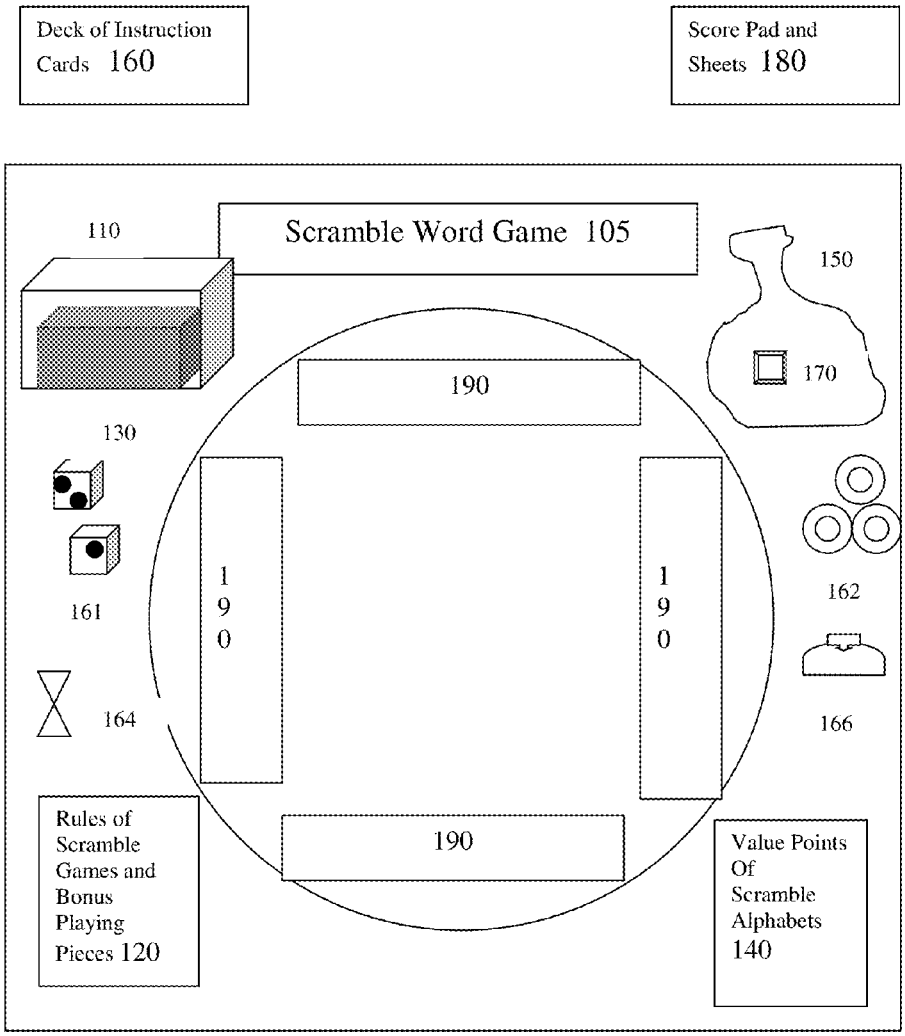
100
Fig. 1 illustration of the Scramble game system and components (not all components are necessary in all of 'Scrammble Games'.

Game board and Accessories for various Scramble Games

| | | | | | |
|---|---|---|---|---|---|
| Scramble Tile Board Game | Board With Instructions | Tile Alphabet Set | Tile Bag | Score Sheet | Optional Accessories |
| Scramble Card Board Game | Board With Instructions | Card Alphabet Set | Card Box | Score Sheet | Optional Accessories |
| Board-Less Scramble Games | No Board | Tile Or Card | Bag Or Box | Score Sheet | Optional Accessories |
| Online Network or TV Game | Computer Or TV Display | Computer Or TV Graphic | Database And software | Computer Form Spreadsheet | Interactive Control |

Fig. 1a The Game Boards and Accessories Supporting Various Scramble Games under Different Playing Conditions and Implementations

| | | | | | | | | | | | | | | | | | | | | | | | | | |
|---|---|---|---|---|---|---|---|---|---|---|---|---|---|---|---|---|---|---|---|---|---|---|---|---|---|
| E | T | A | N | O | I | R | S | H | D | L | C | U | M | F | P | Y | G | W | B | V | K | X | J | Q | Z |

English Scramble Game Alphabets Ranked with Value Points in Increasing Order (Example, 1111122223344556667789,10,11,12,13 with 0 for wild piece)

| | | | | | | | | | | | | | | | | | | | | | | | | | |
|---|---|---|---|---|---|---|---|---|---|---|---|---|---|---|---|---|---|---|---|---|---|---|---|---|---|
| V | K | X | J | Q | Z | B | W | G | P | Y | C | F | M | U | D | L | H | S | I | R | O | A | N | T | E |

English Scramble Game Alphabets Ranked with Distribution in Increasing Occurrence (Example, 1111112233344446677889,10,10,11,15 & 4 wilds)

Fig. 1b Ranking Order of Alphabet Playing Pieces for Playing English Scramble Games

| | | | | | | | |
|---|---|---|---|---|---|---|---|
| 2L | 2R | 3L | 3R | 2L/R | 3L/R | 2X | 3X |

Exemplary Transparent Math Function Card for Overlay on Alphabets
(Math functions can be directly put on playing pieces without using overlay)

Fig. 1c Playing Pieces with Math Functions as Separate Transparent Pieces

| | | | | | |
|---|---|---|---|---|---|
| 1W +word score | 2w + double word score | 3w + triple word score | +10 =7 letters | +20 =8 letters | +30 =9 letters |
| +40 =10 letters | + 50 =11 letters | +50 sentence | +50 Heaven Hu | +30 Earth Hu | +70 = or > 12 letters |

Fig. 1d Examples of Bonus math operators assigned for wild playing pieces (Example, 3W means 3 times the word score as bonus) and Example of bonus for making long words, sentence and special 'Hu' Scramble Games

| Scramble Process | Word Rule | Bonus & Penalty |
|---|---|---|
| One must use at least one open letter and scramble with the letters of one or more existing words to form a new word | Adding letter, S, D,N, ED or EN to a word resulting in a tense change or pluralizing can not be considered as a new word | Long-words are entitled with bonus points per agreement made prior to game start<br>Penalty may be applied to Misspelled or non-existent words if successfully challenged |

Examples of Instruction and Rule Cards for Scramble Games 160

| | **Player 1** | | **Player 2** | | **Player 3** | | **Player 4** | |
|---|---|---|---|---|---|---|---|---|
| **Word** | ABLE (ℓ x2) | **12** | BLAME (ℓ x2) | **17** | S**AMBLE(ℓx2 | **19** | MA*BLE(ℓx2)S | **19** |
| Bonus | 3 (L)x2 | **6** | 5 (M) x 2 | **10** | 19x1+0+1+3x2 | **26** | (1+7)+3x2 | **14** |
| Total | #1 lost to #2 | **18** | #2 lost to #4 | **27** | #3 kept score | **45** | #4 lost to #3 | **33** |
| **Word** | | | | | | | | |
| Bonus | | | | | | | | |
| Total | | | | | | | | |
| **Word** | | | | | | | | |
| Bonus | | | | | | | | |
| Total | | | | | | | | |
| **Word** | | | | | | | | |
| Bonus | | | | | | | | |
| Total | | | | | | | | |
| **Word** | | | | | | | | |
| Bonus | | | | | | | | |
| Total | | | | | | | | |

Example of Score Sheet for Scramble Word Game with Illustration of Scoring 180

Fig. 1e Rules, Score Sheet and Illustration of Scoring

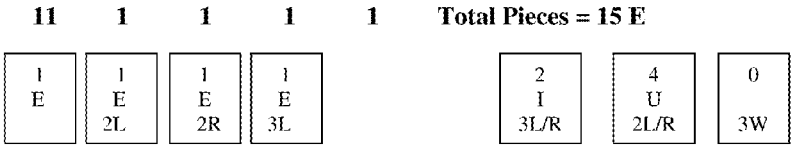

E: 15, value point 1, 11 regular, 4 with multiplier as shown, 2L, 2R, 3L and 3R

T: 11, value point 1; A: 10, value point 1, 6 regular, 4 with 2L, 2R, 3L & 3R

N: 10, value point 1, all regular; O: 9, value point 1, 5 regular 4 with 2L,2R,3L & 3R

I: 8, value point 1, 5 regular 3 with multiplier, 2L,2R & 3L/R; R: 8, value point 2

S: 7, value point 2; H: 7, value point 2; D: 6, value point 3; L: 6, value point 3;

C: 4, value point 4; U: 4, value point 4, 2 regular, 2 with multiplier, 2L/R and 3L/R;

M: 4, value point 5; F: 4, value point 5; P: 3, value point 6; Y: 3, value point 6;

G: 3, value point 6; W: 2, value point 7; B: 2, value point 7; V: 1, value point 8;

K: 1, value point 9; X: 1, value point 10, J: 1, value point 11, Q: 1, value point 12;

Z: 1, value point 13; Wild/Blank: 4, value point 0, L+R, 1W, 2W & 3W

200

Fig. 2 A Representation of the English Scramble Word Alphabet Set (Exemplary assignments: 2L means the value point of the left side of playing piece multiplied by 2 is the bonus, L+R means the value points of the left and right side of playing pieces are added up as bonus and 2w means the entire word score multiplied by 2 is the bonus).

The vowels and wild/blank cards are marked with math function (Example: multiplier factors)

300

| | | | | | | |
|---|---|---|---|---|---|---|
| 1 E | 1 E 2L | 1 E 2R | 1 E 3L | 1 E 3R | 2 I 2L | 2 I 2R |
| 1 A | 1 A 2L | 1 A 2R | 1 A 3L | 1 A 3R | 2 I | 2 I 3R/L |
| 1 O | 1 O 2L | 1 O 2R | 1 O 3L | 1 O 3R | 4 U 2R/L | 4 U 3R/L |
| 4 U | 7 B | ..... | 13 Z | 0 L + R | 0 2W | 0 3W |

2L: multiply value point of letter to the Left by a factor of 2, 3L: a factor of 3

2R: multiply value point of letter to the Right by a factor of 2, 3R: a factor of 3

R/L: multiply value point of letter either Left or Right by the number factor; 2L/R: A factor of 2; 3L/R: a factor of 3

L+R: add value points of letter to the left and to the right

1W, 2W or 3W: multiply the total value points of the word by a factor 1, 2 or 3

Value points for wild playing pieces are zero.

Fig. 3 Examples of Scramble Word Alphabets with Point Value and Math Functions (Example: Multiplication Factors) Indicated and Explained

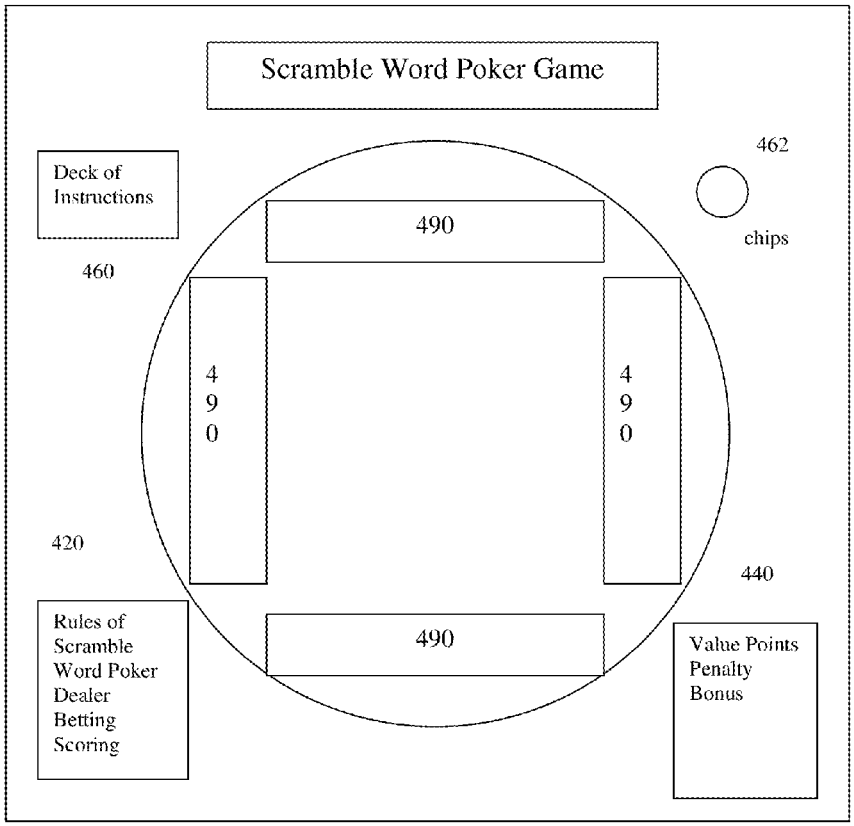
400
Fig. 4 An example of Scramble Poker Game Setting

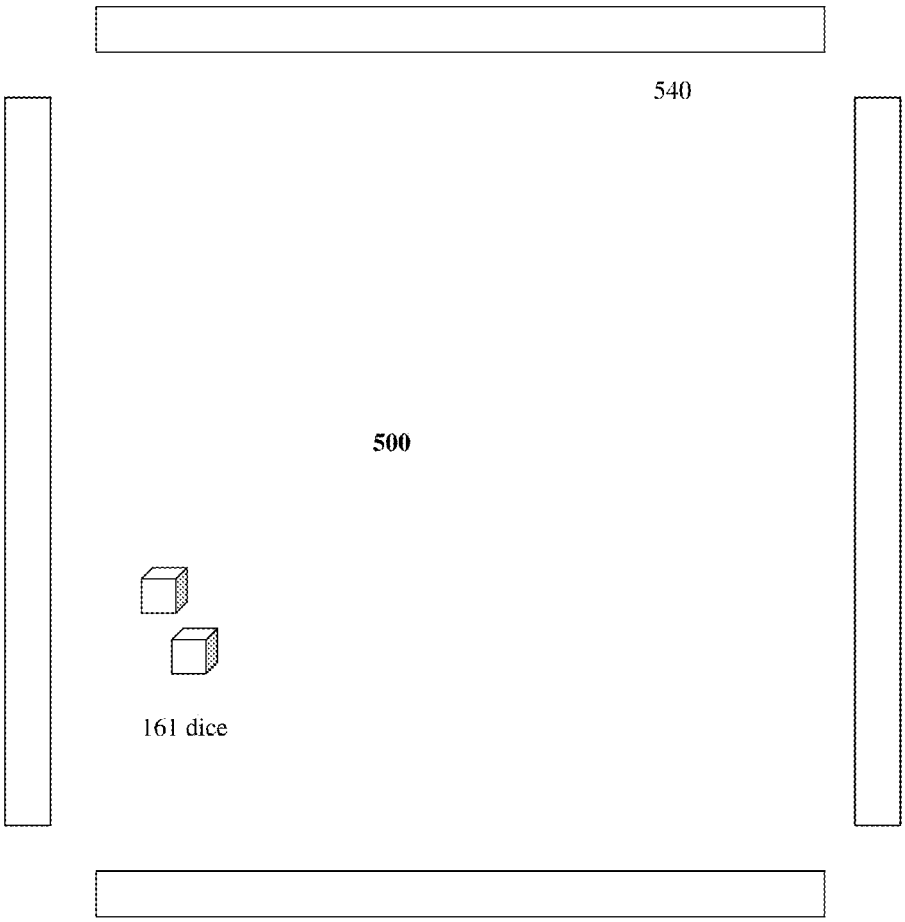
A stack of tiles or cards of 17 pairs 540
Player draws 13 playing pieces to play 'Hu' on 14th piece 550
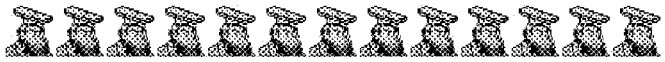
Fig. 5 An example of Scramble Ma-Jong Game Setting

Twenty One 'Hu' Patterns for 13-Tile Ma-Jong (610)

(1)2,3,4,5 (2)2,4,4,4 (3)2,2,4,6 (4)2,3,3,6 (5)2,2,5,5 (6)2,2,3,7 (7)2,2,3,3,4 (8)2,2,2,4,4 (9)2,2,2,3,5 (10)2,3,3,3,3 (11)2,5,7 (12)2,6,6 (13)2,2,2,2,6 (14)2,2,2,8 (15)2,4,8 (16)2,2,2,2,3,3 (17)2,2,2,2,2,4 (18)2,3,9 (19)2,2,10 (20)2,12 (21)2,2,2,2,2,2,2

Sample 'Hu' Patterns

Pattern 1: 2,3,4,5

| | | | | | | | | | | | | | |
|---|---|---|---|---|---|---|---|---|---|---|---|---|---|
| **W** | **E** | **A** | **T** | **E** | **Y** | **O** | **U** | **R** | **L** | **U** | **N** | **C** | **H** |

2: WE, 3: ATE, 4: YOUR, 5: LUNCH 620

Pattern 11: 2, 5, 7

| | | | | | | | | | | | | | |
|---|---|---|---|---|---|---|---|---|---|---|---|---|---|
| **M** | **Y** | **G** | **O** | **O** | **D** | **Y** | **E** | **N** | **G** | **L** | **I** | **S** | **H** |

2: MY, 5: GOODY, 7: ENGLISH 630

Pattern 14: 2,2,2,8

| | | | | | | | | | | | | | |
|---|---|---|---|---|---|---|---|---|---|---|---|---|---|
| **O** | **N** | **T** | **O** | **H** | **E** | **M** | **I** | **L** | **I** | **T** | **A** | **R** | **Y** |

2: ON, 2: TO, 2: HE, 8: MILITARY 640

Fig. 6 A List of 21 Patterns of 'Hu' in Scramble Word Ma-Jong and Some Examples of 'Hu' Pattern of Scramble Word Ma-Jong Game (Note: we ate your lunch is a sentence which may gain sentence bonus points)

Scrammble Bingo Card (A E I O U *)

Designate A E I O U and a wild in five cells of any one diagonal line with your preferred choice of vowels

| | | | | |
|---|---|---|---|---|
| I | | | | |
| | * | | | |
| | | E | | |
| | | | U | |
| | | | | O |

To make words according to a Bingo pattern using the letters that are drawn , First done wins!

| | | | | |
|---|---|---|---|---|
| I | | BRED | | |
| | * | BED | | |
| | | BE | | |
| | | BREAD | U | |
| | | BRAKED | | O |

| | | | | | | | | | | |
|---|---|---|---|---|---|---|---|---|---|---|
| E | B | Q | T | D | R | A | C | K | | |
| B | E | | | | | | | | B | E |
| B | E | T | | | | | | B | E | D |
| D | E | B | T | | | | B | R | E | D |
| B | A | T | E | D | | B | R | E | A | D |
| | | | | | B | R | A | C | E | D |
| | | | | | B | R | A | K | E | D |

Fig. 7 Scrammble Bingo Game Card and Play Method (Example: Vertical line pattern, five words in a line, the letters can only be used once to form a word unless the letters of the entire word is inclusive in another word)

WORD SCRAMBLE GAMES FOR STIMULATING BRAIN AND PHYSICAL HEALTH

CROSS-REFERENCE TO RELATED APPLICATIONS

US Patent Documents: application Ser. No. 10/331,092, file date: Dec. 30, 2002, Original filing, ruled abandonment Foreign Patent Documents: PCT/US03/41428, International filing date: 23 Dec., 2003

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC AND MICROFICHE

Not Applicable

BACKGROUND OF THE INVENTION

1. Field of Invention

The present invention relates to a word game system with an assembly of game components and a set of play methods for the purpose of providing mind stimulation and entertainment which can improve human brain and physical health. The game system is based on the principle of dynamically, continuously and constantly scrambling alphabets in one's brains to form meaningful words to win score, which stimulates brain activities in a healthy way. The assembly of game components is created to (1) make such brain activities to be fun and not stressful, (2) support a number of games and a variety of play methods and (3) facilitate the play methods of 'word scramble process' based word games. The play methods of Scramble games are applicable to a variety of board games, card games, tile games, TV broadcast shows, interactive TV games, computer games and network or online interactive computer or cell-phone based games. The game system components and play methods implemented in TV and/or interactive TV renders them a mass entertainment game with participation of audience in television, cable and Internet broadcast through remote control. In any of the playing formats, the brain stimulation function is achieved by constantly, continuously and dynamically scrambling words during the games to stimulate and improve the players' brain and physical health. The present invention and its varying play methods are suitable for solitaire play and group play in physical presence such as in a family over a table, a classroom setting as well as for a large number of players over a network connection including computer network and wireless network such as Internet, TV broadcast, cell phone network, interactive Cable TV or any combined network providing player interaction.

2. Description of the Related Art

In today's fast speed and schedule-driven work and social environment, people very much need to relax and spend time with family members and friends for both physical and mental health reasons. Consequently, many games have been invented to provide entertainment and family interaction. Unfortunately, many games are of the category that they do not stand the test of time because they don't provide the right challenge to people's brains. These are the "luck" games by throwing a die and following instructions or 'trivia' games causing brain clutter or the pulling-the-trigger games only stimulating finger and eye coordination with little thinking activities. In fact, some of the games are wasting precious time of young children whose brains are in the development stage which can be accelerated from healthy stimulation with proper learning games.

A few games that do endure years of test are all brain stimulating games challenging and entertaining. Examples are (1) Bridge—A English invention originated from Whist dated to 17$^{th}$ Century, Whist was said to come from Whisk which was called Trump, which was transformed from a French game called Triomph, (2) Chess—An invention dated back to 531 AD to India, (3) Scrabble—An American invention attributed to Alfred Butts in 1931, Poughkeepsie, N.Y., (4) Poker—traced back to Chinese 900 AD Domino cards and French 1480 Pogue card game and (5) Ma-Jong—Chinese game dated back at least 12$^{th}$ century and possibly earlier in simpler forms. These games stood the test of time mainly because they are both entertaining and brain stimulating and challenging. The Bridge and Chess are often contending for the throne of the most popular game in the world if one would include all card games and board games in the same category. However, they are sometimes viewed as too difficult to get young children and seniors to learn and play. Poker and Majong are popular gambling games, but they are not appropriate for children to play. Word games such as Scrabble and crossword puzzles are considered learning games but they are not attracting children as much due to their play method which do not catch or have difficulty to maintain players' constant and continuous attention during the game play, especially for children.

Recently, there are clinical studies confirming the benefit of engaging brain stimulating activities for health.

Researchers have found that those who had engaged in stimulating activities throughout their life—everything from reading, doing crossword puzzles, and playing bridge, chess, or board games to visiting friends, practicing a musical instrument, and bicycling—were 2½ times less likely to get Alzheimer's. Alzheimer's disease is a mental condition that affects the portion of the brain that controls thought, memory, and language.

Brain-stimulating activities such as newspaper-reading, card games, puzzles and draughts had been shown in "the best study of the problem so far" to lower the risk of Dementia.

Human brain is like a muscle: Use it or lose it. Today's research offers evidence showing that taking steps to protect your brain can prevent a decreased memory and slowed wit. Mental exercise is crucial. It begins when parents read to their children. But it is never too late to stimulate the brain. Therefore, the general object of the present invention, collectively referred as 'Scrammble Games', which will become clear as a class of unique word games with descriptions below, is to provide a game system and a set of play methods for the general public, children and all ages, for the benefit of maintaining good physical and mental health. Another object is to provide family and group entertainment and learning. A number of games and their play methods are presented in the present invention.

Word Games are Created in a Particular Language.

The Scramble Games are extendable from English, an alphabetic language, such as Spanish, French, German, Russian, Arabic, or Italian and moreover are also extendable to non-alphabetical languages such as Chinese, Japanese or Korean when the non-alphabetical words are represented by a combination of symbols as a part of a small set of symbols such as radicals or when the non-alphabetical words are represented by a combination of alphabets taken from an alphabetical language or symbol system such as Zhu-Yin used in representation of Mandarin.

BRIEF SUMMARY OF THE INVENTION

The 'Scrammble Games' system and their play methods are based on a set of playing pieces uniquely created to support a multiple number of games which utilize the essential element, 'Scramble Process' or 'Word Scramble Process'; that is constantly, continuously and dynamically scrambling alphabets during the games cognizant and taking advantage of the properties of the playing pieces to form new and longer words by adding and scrambling the playing pieces during the game. The playing pieces are assigned value points and mathematic functions or operators operable on value points on adjacent and/or all playing pieces physically connected in a word. The multiple number of games, collectively referred as 'Scrammble Games', all possessing the unique properties of 'word scramble process' and the 'Scrammble Set' defined below, often adopt certain elements of existing familiar games hence can be named separately but always retain their unique properties to offer learning and entertaining features in each game. Hence, each individual 'Scrammble Game' is named with the word 'Scrammble' plus a few words to remind players a familiar game but played with a 'word scramble process' with an unique playing method and the 'Scrammble Set' to provide word learning and entertainment. The 'Scrammble Games' include Scrammble Word, Scrammble Bingo, Scrammble Bridge, Scrammble Crossword, Scrammble Go-Fish, Scrammble Hangman, Scrammble Mastermind, Scramble Poker, Scramble Ma-Jong, Scrammble Puzzle, Scrammble Charade, Scrammble Solitaire, Scrammble Tic-tact-toe and Scrammble War, just to name a few.

The invention can be summarized by describing an exemplary playing scenario in the Scramble Word Game to illustrate the 'word scrambling' or 'word scrambling process' which is a 'constantly, continuously and dynamically word scrambling process'. This process utilizes a set of playing pieces, the 'Scrammble Set', which contains playing pieces marked with alphabets and symbols of a language ranked in a specific 'order' with a specific 'ranking distribution' and contains specific 'value points' and 'math functions' or math operators suitable for supporting a multiple number of 'word scrambling process' based word games. The 'order' means each alphabet playing piece is ranked by its occurrence or 'distribution ranking' in the set of playing pieces, such as in English, e, t, a, n, o, i, r, s, h, d, l, c, u, m, f, p, y, g, w, b, v, k, x, j, q, and z from most frequently occurring to least frequently occurring alphabet. This order is derived from inventor's research on vocabulary in dictionaries not words in books, news paper or emails as done to determine frequency of occurrence for words. Each playing piece is also assigned by a specific 'value point' which is inversely proportional to its 'distribution ranking' in the set of playing pieces. To create an unique property for the 'word scramble process' and to provide meaning or incentive for performing scrambling, certain number of playing pieces are assigned with 'math functions' or 'math operators' which produce 'bonus value points', sometimes 'penalties', depending on how the playing pieces are scrambled and placed with respect to each other in a newly formed word as illustrated by examples in the drawings and detailed descriptions below. The entire Scrammble Game System comprises of the 'Scrammble Set' with a definite number of playing pieces including alphabets, symbols and 'wild' pieces—piece can be dynamically assigned as any alphabet or symbol—all ordered in distribution number and all with value points and at least some with math function operators.

An exemplary playing scenario for 'Scrammble Word' is summarized first to ease the description of the entire 'Scrammble Games' later and the explanation of the detailed roles of each game system component in the next section:

Players or dealers can take turn to flip open a playing piece from a 'Scrammble Set', but any player at any time can form a word out of the opened playing pieces and claim the word. Any player at any time can scramble a formed word into a new word by adding at least one playing piece from the opened playing pieces and by taking advantages of the incentives and bonuses whenever possible to form a longer word with a word score uniquely defined by the value points and math operations on the adjacent and all the playing pieces in a word. Hence the game commands 100% attention—'word scrambling and math operation'—of all the players all the time with no necessary order or sequence, rendering the game extremely stimulating. Winning can change quickly from player to player, hence making the game extremely exciting. This playing scenario defines a Scrammble Word game. Incorporating the 'word scramble process' in other play methods defines different Scrammble Games. For example, the Scrammble Poker applies the 'word scramble process' into a 'Scrammble Poker hand', for example, a 7-piece or 5-piece hand, playing 7-letter or 5-letter word formation, adding more excitement and learning value into the game absent in an ordinary Poker game. The Scrammble Ma-jong, on the other hand, applies the 'word scramble process' into a 'Scrammble Ma-jong hand' of 13 or 16 playing pieces, adding more brain stimulation and word learning element into the game non-existent in an ordinary Ma-jong game. The Scrammble Bingo applies the 'word scrambling process' into a Scrammble Bingo card creating an educational Bingo game where players are formulating a Bingo pattern in words instead of numbers by using available playing pieces and the 'Word Scramble Process' to achieve Scrammble Bingo. The Scrammble Crossword applies the 'Word Scramble Process' in a 'crossword pattern' adding more challenge as a vocabulary game by allowing stealing and scrambling a branch in a crossword pattern to form a new longer word or higher score word by a player. The Scrammble Go-Fish instead forming pairs of identical playing pieces, it challenges players to form words using the 'word Scramble process'. The Scrammble Hangman uses a man's body parts as in an ordinary Hangman Game to place Scrammble playing pieces to let players make and scramble words. The man would be hung if the player failed to make words from the available playing pieces. The Scrammble Mastermind applies the 'word scramble process' in solving a word mastermind game. The Scrammble Solitaire is a collection of solitaire games based on 'word scramble process' and the 'Scrammble Set'. The Scrammble Puzzle is a collection of word puzzles utilizing the 'word scramble process' to solve the puzzles. The Scrammble Tic-tact-toe applies the 'word scrambling process' in a generalized tic-tac-toe pattern of N by N hence challenging players to form words of N playing pieces in a straight line. The Scrammble War applies the 'word scramble process' to change a war game with ordinary Poker cards to a vocabulary war game using the 'Scrammble Set' offering tremendous pedagogical value as well as brain stimulation value. Scrammble Bridge incorporates 'word scramble process' in bridge contract bidding creating an interesting and challenging word Bridge game. All the above mentioned games with the exception of a few Scrammble Puzzle games are using a set of playing pieces in alphabets or symbols of a language, each replicated in number by its 'distribution ranking' and each assigned an appropriate 'value point' and at least some assigned with 'math functions' or 'math operators' defined as the 'Scrammble Set'.

These and other similar Scrammble Games will be illustrated further in detail with preferred embodiments. The implementation of these games will become apparent for the skilled in the game art following the illustrative figures and examples given in the detailed description. It must be understood that the above said games can be played with all or part of the game system components; that is with or without a board and with all or some of the playing pieces depending on the physical environment and kinds of players involved. The game board can be optional. The playing pieces are produced in different forms like card, tile, or chip with different materials such as paper, plastic, marble or wood to accommodate convenient playing of multiple 'Scramble Games' under different physical environments, such as home, classroom, beach and travelling vehicles.

The 'Scrammble Games' are suitable for implementation as a computer game by using computer generated graphics to represent the playing pieces and by programming the value points and math functions to display the results instantly to players. The 'Scrammble Games' are also suitable for implementation in a network environment, computer network such as LAN, telecommunication network such as ISDN, Internet such as via DSL, ADSL or Cable, Wireless network such as wireless Internet or mobile phone network and Cable TV network such as broadcasting TV or Interactive TV. The game system and its components have also been simulated by computer generated images making scramble games playable as computer assisted TV broadcast games. The implementation of these games will become apparent for the skilled in the art with the details of the present invention presented below.

BRIEF DESCRIPTION OF THE DRAWINGS

FIG. 1 Illustration of the Scramble Game system and components (Not all components are necessary in all Scrammble Games)

FIG. 1*a* The Game Boards and Accessories Supporting Various Scramble Games under Different Playing Conditions and Implementations FIG. 1*b* Ranking Order of Alphabet Playing Pieces for Playing English Scramble Games FIG. 1*c* Playing Pieces with Math Functions as Separate Transparent Pieces FIG. 1*d* Examples of Bonus math operators assigned for wild playing pieces (Example, 3W means 3 times the word score as bonus) and Example of bonus for making long words, sentence and special 'Hu' Scramble Games FIG. 1*e*. Rules, Score Sheet and Illustration of Scoring FIG. 2 A representation of the English Scrammble Word Alphabet Set (Exemplary assignments: 2L means the value point of the left side of a playing piece multiplied by 2 is the bonus, L+R means the value points of the left and right side of playing pieces are added up as bonus and 2w means the entire word score multiplied by 2 is the bonus)

FIG. 3 Examples of Scramble Word Playing Pieces with Value Point and Math Functions Indicated and Explained FIG. 4 An example of Scrammble Poker Game Setting FIG. 5 An example of Scrammble Ma-Jong Game Setting FIG. 6 A List of 21 Patterns of 'Hu' in Scrammble Ma-Jong and Some Examples of 'Hu' Pattern of Scrammble Ma-Jong Game (Example: we ate your lunch is a sentence which may gain sentence bonus points)

FIG. 7 Scrammble Bingo Game Card and Play Method (Example: Vertical line pattern, five words in a line, the letters can only be used once to form a word unless the letters of the entire word is inclusive in a new word)

DETAILED DESCRIPTION OF THE INVENTION

The present invention provides a word game system and a set of play methods and its variations based on the 'word scramble process' to form words to win word games using an unique set of playing pieces and corresponding play methods for the benefit of stimulating brain activities and maintaining physical health as well as having fun.

The system components first, then the play methods next, are illustrated below. As most interesting games are, there are more possible variations of play methods than can be covered in a finite volume of description. Hence, only a few examples are described here. Those who are skilled in creating games or playing games will be able to extend from the examples illustrated below to create many other variations based on the essential 'scramble process' in the 'Scrammble Set' and play methods.

An exemplary game system is described below for illustration of the multiple Scrammble Games and their play methods:

A. The System Components of the 'Scrammble Games' System

The Scrammble game system as shown in FIG. 1 is designed for playing multiple Scrammble games. It consists of (1) A board, 100, with specific markings and place holders for playing piece containers, a box, 110, containing playing pieces, 130, cards, and a bag, 150, containing playing pieces, 170, tiles, and printings of instructions: rules, 120, value points, 140, and playing piece placement position, 190 to facilitate multiple game playing. The board, 100, is a multi-sided cardboard, fabric, wood, plastic or ceramic plate. Printed on the top surface of the board include the name of the game(s), 105, the rules of the game(s), 120, the value points, 140, which may include definition of math functional operators, such as multiplier factors assigned to each playing piece and the bonus and wild playing piece, a deck of instructions, 160, a scoring pad, 180, and a large circle in the middle of the board which facilitates placement of the playing pieces if needed. Markings on the board are holding spaces for containers, 110 and 150, and holding place, 190, for playing pieces, for Scrammble Poker, it includes 5, 7 or more positions to accommodate the Scrammble Poker playing pieces whereas for Scrammble M-Jong, the marking, 190, is 13 and 16 positions to accommodate the Scrammble Ma-Jong playing pieces. As shown in FIG. 1*a*., the board with the selected accessories can support different Scrammble Games and play methods under different physical playing environments but not necessarily all used in every Scrammble Game.

(2) Two containers in a box form, 110, and a bag form, 150, for keeping the playing pieces, 130, cards, and 170, tiles, respectively.

(3) A set of playing pieces, 130 and 170 which can be made of paper, wood, plastic, ceramic or any other suitable materials as well as being represented by computer graphics. Playing pieces are uniquely defined with ranking order and value points as illustrated in FIG. 1*b*. Playing pieces are further defined with math function operators and/or Bonus multiplication factors including 'wild' playing pieces and other symbols, as shown in FIG. 1*c*, are included as a part of the unique alphabet set making the set uniquely suited for word scrambling process. The math functions can be directly implemented on the playing pieces or as separate pieces as illustrated in FIG. 1*c*. The function of the math operators and additional bonus rules are illustrated in FIG. 1 *d,*

(4) A deck of instructions and playing rules in the form of paper cards or sheets as shown in FIG. 1, 160, and further illustrated in FIG. 1*e,*

(5) A score recording pad or sheets as indicated in FIG. 1, 180, and further illustrated in FIG. 1*e* to facilitate recording of the play results, (6) dice as shown in FIG. 1, 161, for determining play sequence or seating arrangement, (7) chips, 162, FIG. 1, for facilitating settlements of winning and losing.

(8) A timer, 164, FIG. 1, for keeping time if needed or desired; and (9) an alarm bell or an electronic buzzer system, 166, FIG. 1, for determining who has indicated first to act or declare the formation of a word or the completion of a game. These optional items (6)-(9) are commonly available in many other games, hence they are optional items in the present game system. They may be omitted in game playing without sacrificing the principal spirit of the games described here but they do provide convenience if used. The other components are used for Scrammble Games as the play methods and playing conditions dictate. The component item (3), the playing pieces as illustrated in FIG. 1*b*-1*d*, is the essential 'Scrammble Set', which is further illustrated in FIGS. 2 and 3 in detail.

The set of playing pieces including duplicates, math function operator, bonus and wild playing pieces are made of suitable material such as paper, wood, plastic, rubber the like including magnetic material for playing the game on a magnetic board. In one embodiment as shown in FIGS. 2 and 3, on one side of the surface, a printing or carving or molding of an alphabet is made along with a number and function symbol(s) which represent math operation on the value point of the adjacent and/or remote playing pieces and/or the entire scrambled word respectively. The playing pieces are arranged in order ranked by the value points and ranked by its distribution ranking in the set as shown in FIG. 1*b*. In one preferred embodiment, the math functions are implemented as separate playing pieces as shown in FIG. 1*c*. In another preferred embodiment, the math functions are superposed on the alphabet playing pieces as shown in FIGS. 2 and 3. Separately, the math function playing pieces being partly transparent can be overlayed over the alphabet playing pieces they operate on. The bonus cards are shown in FIG. 1*d* where wild playing piece and long-word bonus are given as examples. The tile playing pieces of the alphabet set are made into shapes so that they can stand on their own without a holding rack most suitable for Scrammble Ma-jong. On the other side of the alphabet playing piece, a cheerful pattern is printed such as flowers, pets, King's image and scenery to make the cards or tiles pleasing to the brain. Marketing and advertising verses and images are added on the playing piece to promote an organization or business which supports education and brain health.

The deck of instructions and playing rules, 160, are printed on the board as shown in FIG. 1 and on paper cards as shown in FIG. 1*e* which can be easily replaced if lost and can be easily modified with pencils if desired. The rules of the games are just guidelines; players certainly can make their own modifications so long the principles of the games are not destroyed. For popular accepted rules, the deck of instructions or rules are carved on wood or molded on plastic to give them durability.

The exemplary score pad or score sheets as shown in FIG. 1*e* are simply made of paper or presented in computer forms. These predesigned forms can save time and make the score keeping simple so that players can focus on the scramble process. Chips may be used in lieu of record keeping to simulate an exciting ambient of a casino.

B. The Construction of Playing Pieces

The alphabet playing pieces are made in tile and card form so they can be suitably played as tile board game, card board game and boardless games as the physical environments dictate the best play system and play method without losing the principal value of the scrambling games. The Scramble Games are suitable for all alphabetical and ideographical languages. For clarity purposes, the construction of one English set is described in detail as an example:

1. Twenty-six English alphabets are selected for English Scramble games. Other languages may have more or less number of alphabets and/or symbols. The alphabets are assigned a value point and some with math function operators superimposed, one type of math function is to multiply the word score and the other type to multiply the adjacent letter's value point, left or right or above or below for instance in a Scrammble Word Game or Scrammble Crossword Game. These math functions give incentives to perform word scramble process. Alternatively, the math functions are made on separate piece with transparent material as shown in FIG. 1*c* so that they can be overlaid over the alphabets to perform the math functions. These transparent overlays can be used to change word score in competitive Scrammble Games such as the Scrammble Word game in an interactive TV mode.
2. 2-8 blank wild playing pieces having a value point such as zero assigned on it and having a math function such as multiplication operator are exemplified in the illustrative set in FIG. 1*d*. The wild playing piece has the characteristics to be usable as any arbitrary alphabet; therefore, they are powerful pieces. The math function, for instance, a multiplier factor multiplies the word points, a sum of all alphabet points in a word, with a factor; hence, it increases the total points by that factor. Any bonus or wild playing piece with a multiplier factor is more valuable for forming the words but they also make the word more vulnerable since opponents will more likely to steal that word by using the word scrambling process.
3. Hyphen, apostrophe, accent or other symbols used in any language to form a part of the word are included to play Scrammble games in any language where they may be preferred.
4. For non-alphabetical language such as Chinese, the radicals or Zhu-Yin, symbols can be used instead of any alphabets. The Chinese ideographs are formed by a set of radicals in a two dimensional space in contrast to alphabetical language typically arranged in one dimensional sequence. Hence the basic playing system and rules in the present invention can be extended to traditional Chinese language, simplified Chinese language and other languages such as Japanese or Korean based on the Chinese ideographs extending the 'word scramble process' to include two dimensional scrambling of the playing pieces, namely the radicals. The scramble games can also be extended to the Chinese language using its 'Han-Yu-Pin-Yin', an alphabetical representation of Chinese words and 'Zu-Yin', a symbolic representation of the pronounced sound of Chinese language as playing pieces to be played in a similar manner as in an alphabetical language.

C. The Point System for Ranking the Alphabet Playing Pieces

In the English language, the 26 alphabets are not used evenly to form words. For instance, the vowels are used more frequently than consonants. In English words, there are always one or more vowels or at least a semi-vowel such as y present. In a study the inventor when investigating Optical Character Recognition algorithms, such statistics was compiled on frequency of occurrence of words in daily news papers and subsequently further analysis of frequency of occurrence of alphabets was also compiled. For instance, the word 'the' is the most frequently occurring word and the alphabet 'e' is the most frequently occurring letter. Many studies have been made in compiling frequency of occurrence of words and alphabets based on books, newspapers and correspondences. However, there is no compilation of distribution ranking order of alphabets for word games based on the 'word scramble process', ideally based on vocabulary in dictionaries. Given a set of alphabet playing pieces, the probability of being able to form a word using the remaining alphabets is entirely different if the previously formed words are excluded versus allowed to be reused or scrambled as in the word scrambling process disclosed here. One example of word games that exclude the previously played alphabets and words from reused or scrambled is the popular game called Scrabble. This is an important distinction for all Scrammble Games such as Scrammble Word, Scrammble Poker, and others. Through statistical analysis of English vocabulary, comparing several dictionaries of distinctive words, the inventor has determined a 'distribution ranking order' of the alphabets for the English alphabets suitable for playing the word scramble process in the Scrammble Games as follows:

e, t, a, n, o, i, r, s, h, d, l, c, u, m, f, p, y, g, w, b, v, k, x, j, q, and z The value point of every alphabet in the 'Scramble Set' is selected to be inversely proportional to the 'distribution ranking order' as shown in FIG. 1*b*. The less frequently occurring alphabets are assigned higher value points but given less playing pieces as shown in FIG. 1 *b* and FIG. 2 with further details illustrated below. Minor variations from the above 'distribution ranking order' are acceptable for Scrammble Games since the statistical compilation does show some deviations.

D. The Distribution System for Ranking the Alphabet Playing Pieces

The number of pieces for each alphabet is proportional to its frequency of occurrence, named the 'distribution ranking'. More pieces are made for the frequently occurring letters or higher ranking alphabet. Based on the inventor's studies, the number of pieces and their value points are assigned to each alphabet playing piece for the Scrammble Games in an illustrative example as follows:

e(15, 1), t(11,1), a(10, 1), n(10,1), o(9,1), I(8,2), r(8,2), s(7,2), h(7,2), d(6,3), l(6,3), c(4,4), u(4,4), m(4,5), f(4, 5), p(3,6), y(3,6), g(3,6), w(2,7), b(2,7), v(1,8), k(1,9), x(1,10), j(1,11), q(1,12), z(1,13) and wild(2-8,0)

Where the first number in the bracket represents the number of duplication of the alphabet playing piece and the second number represents its value point. The duplication number does not have to be indicated on the alphabet playing pieces but it is useful to be indicated on the game board and/or instruction deck. It must be understood that adjustments can be made to the preferred embodiment which still can make the Scrammble Games functional, that is in a word game almost all playing pieces will be used statistically without too many playing pieces left unused.

FIG. 2 shows an exemplary set with the above distribution consisting of a total of 136 playing pieces including 4 wilds is illustrated by a schematic representation, 200, without the distribution ranking information indicated on the playing pieces. Such a set of playing pieces can support the Scrammble Games including Scrammble Word, Scrammble Bingo, Scrammble Bridge, Scrammble Crossword, Scrammble Poker, Scramble Ma-Jong, Scrammble Solitaire and Scrammble Go-Fish and Scrammble Hangman and their variations. In this example, the total 136 playing pieces are distributed from a to z and 4 wild pieces as follows:

a(10), b(2), c(4), d(6), e(15), f(4), g(3), h(7), i(8), j(1), k(1), l(6), m(4), n(10), o(9), p(3), q(1), r(8), s(7), t(11), u(4), v(1), w(2), x(1), y(3), and z(1) plus wild/blank (4) a total of 136 pieces. The markings on individual alphabet playing piece are further explained in section E and in FIG. 3.

The value points assigned to the exemplary alphabet set, 200, are also shown from a to z with wild piece having zero value point as follows:

a(1), b(7), c(4), d(3), e(1), f(5), g(6), h(2), i(2), j(11), k(9), l(3), m(5), n(1), o(1), p(6), q(12), r(2), s(2), t(1), u(4), v(8), w(7), x(10), y(6), and z(13) plus wild (0).

The total value points of the set is 368. It is obvious for those skilled in the art and statistics analysis, the above assignment can be modified with certain flexibility either in value points or in the number of distribution of playing pieces without destroying the basic principle—rendering the Word Scramble Process functional in all Scrammble Games.

E. The Math Function Operator for Enhancing the Word Scramble Process

For illustration purposes, one or more multiplier factors can be assigned as a math function to a certain number of alphabet playing pieces including wild playing pieces. One preferred embodiment as shown in FIGS. 2 and 3, is presented below:

The multiplication factors are added on some pieces to increase the scoring variations. FIG. 3 gives an example of the physical layout of all representative alphabet samples, 300, with the value point system and multiplication factors indicated. Four wild playing pieces are assigned as wild(v1,f1), wild(v2,f2), wild(v3,f3) and wild(v4,f4) where v1 to v4 are selected, for instance, to be 0, meaning zero value point, f1 to f4 are selected, for instance, to be L+R, 1W, 2W and 3W which mean a bonus will be generated by adding value points of left and right playing piece and the word score being multiplied by 1,2 and 3 respectively as bonuses as depicted in FIG. 3. Per players' agreement, the wild playing piece with math functions can be increased or decreased in number to suit the players' preference. For example, other symbols of math functions like 2L/2R or 3L/3R which can be assigned to any playing piece (2L/2R means multiplying the value point of left side or right side or both side of the playing pieces by 2 as bonus, similarly, 3L/3R means multiplying the value point of left side or right side or both sides of the playing pieces by 3 as bonus). With more wild playing pieces, the playing is made more stimulating and with more multiplication factors on wild pieces the scoring is bigger.

In the example as shown in FIG. 2 and FIG. 3, a certain number of vowel playing pieces are marked with math functions as e(1,2L), e(1,2R), a(1,2L), a(1,2R), o(1,2L), o(2,2R), i(2,2L), i(2,2R), u(4,2L/R), e(1,3L), e(1,3R), a(1,3L), a(1,3R), o(1,3L), o(1,3R), i(2,3L/R) and u(4, 3L/R) where the first numeral indicates the value point assigned to the vowel alphabet and the second symbol indicates the math function operator: A multiplication factor, 2 or 3, is applied to the alphabet (letter) value point to the left (L) or right (R) or to either side (L/R) of the vowel. These multiplication factors do not change the probability of word formation but they change the scoring and encourage word scramble process so that players will have to be more strategic about how they use the vowels with what consonants and they will have to do more thinking about which words are worth more to scramble.

F. Play Methods and Rules of the Scramble Games

The play methods of Scramble games disclosed here all incorporate the 'Word Scramble Process' in the games corresponding to a set of playing pieces in a 'Scrammble Set". A few specific play methods are disclosed here for Scramble Word, Scramble Poker and Scramble Majong games as follows:

The Scramble Word Game

1. Any number of people can play the game, limited by the total number of playing pieces. A set of 136 playing pieces is used as one example for illustration. Each player draws a playing piece and one who draws the letter closest to the letter a (in alphabetic sequence) begins. The players take turn in the clockwise direction. Alternatively, a dice can be used to determine the playing sequence.
2. Shuffle all the playing pieces and place them face down in the center of the board. Alternatively, the playing pieces are kept in the container, a bag or a box or graphically represented in a database in a computer game or a network interactive game scenario. Each player will draw from the container.
3. Before the game begins, the players agree on the minimum length of letters, symbols or alphabets, required to form a word for the game, for example, 3 letter word, 4 letter word or 5 letter word, etc. Naturally, the longer the word length, the harder is the game. This rule can be included in the deck of instructions. For example, one draws randomly from the deck to set up the playing rules such as the minimum length of letters to be used to form a word, number of wild playing pieces to be used etc.
4. Each player takes a turn to flip open one letter, alphabet, at a time and place it in the center of the board. The Player opens the playing piece facing toward the center of the board to avoid unfair advantage of peeking it first. When anyone recognizes that a word equal or greater than the minimum length can be formed out of the playing pieces in the center of the board or table, he or she can declare it by saying scramble! or the word itself or pressing a buzzer or remote control according to the game rule and game setting. Then the declarer takes the word into his or her possession by placing it in front of the person with alphabets facing the person or on a computer or TV display area associated with the player. When different players declare different words, the one declared first, wins his or her word. When there is a tie in declaration, the player declared a longer word wins or the tie may be settled by throwing a pair of dice to settle the winner or both declaration can be voided. When a player makes a false declaration, that is his or her declared word can not be formed by the open playing pieces on the board with or without stealing an already formed word; the player will be muted for one round of play or penalized by a game score.
5. Any player at any time can recognize a new word by adding one or more playing pieces that are open on the board to a word possessed by another player or by himself or herself. This is the 'word scramble process' with stealing or sometimes referred as the 'stealing process'. The new word of course must be longer than the original word with added letters'Scrambled in'. The player declares the new word will then possess the new word captured from the opponent player or himself or herself. By agreement among players, rules may be added to restrict adding a letter 's' or 'd' or 'ed', or 'n' or 'en' to a word since it is still considered as the same word except a plurality change or tense change. The players should make this rule clear before the game begins.
6. The wild playing piece can be designated to be any alphabet by a player during word scramble process to form a word. When a word containing the wild playing piece is captured by a scrambling process, the wild playing piece can be changed to another alphabet or alternatively must remain to be its initially assigned alphabet as the players prefer. The players should make this rule clear before the game begins.
7. The game continues until all the playing pieces have been opened and placed on the board. After a player drew the last playing piece, whether there is a word declaration or not; there will be a last "Scramble" time, usually a couple of minutes, for all players to examine each other's possessed words to determine whether there is any 'scrambling' possibilities. That is merging and capturing already formed words to new words by adding at least one playing piece. If none, the game ends and the score is counted and recorded.
8. The score is tabulated by adding the value points of every word won. The math functions, such as the multiplication factors, are used to encourage scrambling and to increase the score points as bonuses as described above and in FIGS. 2 and 3. The double or triple letter point multiplier are applied to the alphabet adjacent to the multiplier vowel as specified on the playing piece. The double or triple word score multiplier is applied to the total word points. There may be a bonus score added to the words equal or longer than 7 letters. The bonus points can be assigned, for example, 10 points for 7 letter word, 20 points for 8 letter word, 30 points for 9 letter word and so on. The total score is compared and recorded. The winner with the highest score starts the next game.

When the Scramble Word is played as a TV broadcast game, an electronic bell is used to make the declaration via remote control through an interactive network connection. In a modern interactive TV setting or networked interactive computer game setting, audience or players can participate by using the remote control panel or a cell phone to send a message to the interactive TV station or the network game server or the broadcasting station. In an interactive TV mode, The audience can select to side with any one player on TV then the selected player's playing pieces and words are highlighted for the participating audience to differentiate from other players' words and playing pieces. If all audience would select to be spectators, then all players' playing pieces and drawings need not be highlighted for the audience. When the Scramble Word and the scramble process are played over a computer network, conventional computer, keyboard and mouse are used to transmit the messages of scramble process. This type of participatory and interactive games are very entertaining for family watching or playing with another family remotely. Naturally, the game host can set or modify the rules of engagement for the players but the spirit of keeping players alert and thinking, constantly using the word scramble process is the object of the game.

The Scrammble Poker Game

The Scrammble Poker game is a word game based on the concept of constantly and dynamically scrambling alphabets to form words in a brain stimulating game. Scramble Poker can be played as a board game as well as in a card game style without a game board. However, a game board is convenient and useful for indicating the basic rules to avoid confusions. FIG. 4 shows a schematic game board, 400, where rules. 420, and alphabet value points, 440, and game instructions, 460, are marked as well as described in FIG. 1*d* and FIG. 2. To facilitate the Poker spirit, chips, 462, can be used for settling winnings. Markings for placement position, 490, for the playing pieces on every side of the board guides players to place their playing pieces in front of them. The game is played by any number of people taking turn to create words in their hands with a set of alphabet playing pieces using a Scrammble Set. Players can agree to play a 2 letter poker, 3 letter poker and so on by drawing from the deck of instructions and rules or simply by a 'ladies' or gentlemen's agreement. The 5 letter Scramble Poker is used as an example below to illustrate how the game is played. The game consists of a set of alphabet playing pieces. A Scramble alphabet set, consisting of 136 pieces, is used to illustrate the game. The object of the game is to be the first forming a word with the playing pieces drawn to one's hand and declaring it. The winning score is determined by adding the value points on the alphabet playing pieces and all bonus points if any. The game can be played with a variety of rules depending on the age or knowledge of the vocabulary of the players. A couple of exemplary versions including one indulging in Poker's betting and bluffing are described below.

Version One

1. Any number of people can play the game, limited by the total number of playing pieces, for example, 136, in a Scrammble Set. The players then take turns in the clockwise direction as the game begins.
2. Shuffle all the playing pieces and place them face down in the center of the Board as the 'play set'. Alternatively, the playing pieces are kept in a container for each player to draw. In a computer interactive mode, the shuffling of playing pieces is done by a software program.
3. Before the game begins, the players agree on a Scramble Poker game rules. For example, the minimum length of a word to play can be determined by drawing from the deck of instructions, 3 letter word, 4 letter word or 5 letter word poker etc. Naturally, the longer the word length, the harder is the game.
4. Each player first draws 5 playing pieces, for instance, for playing the 5 letter Scrammble poker game. The object is to form a word of at least 5 letters (alphabets). If anyone has a word in his or her hand before the additional drawing begins, then he or she can declare the word and win the first round. If more than one player declares a word, then the player with highest word points, summing all value points and bonuses of the playing pieces forming the word, wins. If no word is declared then next player continues. The game continues until someone declares a word and wins. All the open playing pieces on the board can be taken up in the scramble process at any time including during the player's turn. A player can change up to five alphabets to form the 'play set' during his or her turn to form a word with at least one letter longer than the minimum-length word (5 letters for instance) and declare it. This give the player who has very bad distribution of playing pieces to have a chance to get better playing pieces.
5. The winner keeps the word in front of him. Every one else discards and shuffle their playing pieces either back into the container or onto the board removed them from the next round. This selection rule must be made clear in the beginning since it dictates the strategy of the game and challenges the memory of the player to remember what have been removed.
6. The winner begins the second round by drawing 5 playing pieces again. Other players follow suit like the first round except now the "Scramble" intensifies in the game. The players can recognize a new word by adding one or more alphabet playing pieces from his or her own hand to the declared words opened in front of all players, the owners. The new word of course must be longer than the original word with added alphabet(s) 'scramble in'. The player who declared the new word will then possess or capture the new word from the opponent player and place it in front. By agreement among players, rules may be added to forbid adding a letter 's' or 'd' or 'ed' or 'n' or 'en' to a word without scrambling since the action does not produce a new word except a plurality change or tense change. By agreement, this capture can only take place when the captor can declare the remaining playing pieces as a word or words and lay them down at the time of capture. Alternatively, by agreement, this capture can take place even when the captor can not declare the remaining playing pieces as a word or words. The next player in sequence simply continues on the game. The round is completed when a player can form and declare a word or words with all of the remaining alphabets with or without alphabets from the open board. The player is not obligated to declare a word if it is to the advantage of the player to continue the scramble process. Since the remaining rounds have less than a complete set of alphabets, the players must try to memorize the letters that were removed from the previous rounds.
7. The game continues until all playing pieces have been used up or become not sufficient for players to draw 5 playing pieces. Then the game ends. The winning scores can be tallied up or settled using chips. Players can begin a new game again.
8. The scores are tabulated by adding the value points and bonuses of every word won by each player. The counting of the points follows the rules for the alphabet set used as shown in FIG. 2. For each game, there will be a score for each player, total value points with bonuses won. The final score is tallied up with each game score. In tallying the word score, additional bonus points may be added to the words if they are equal or longer than 7 letters. The bonus points can be assigned, for example, 10 points for 7 letter word, 20 points for 8 letter word, 30 points for 9 letter word and so on. The total score is compared and recorded. The champion is the winner with the highest score.

Version 2

Another version of the Scramble Poker adopts more the poker rules and encourages the use of familiar poker playing skills such as betting and bluffing, hence more suitable for grown-up players. The game is played more like a poker game where players can raise bets. The game rule may be varied according to the players' age or knowledge of vocabulary. One may simply draw from the deck of instructions and rules to determine what playing rules to follow instead of improvising as many poker games do. One example is illustrated below:

1. Any number of players can play the game, limited by the number of playing pieces in the set. The Scrammble set of 136 playing pieces can be used for this Scramble Poker. Players can throw dice or draw letter to determine who will be the dealer.
2. The dealer deals the alphabet playing pieces like in a poker game, that is dealing two playing pieces to each player. The receiver who received the first playing piece starts the bet. Other players can follow or raise the bet or quit depending on whether a good or a bad combination is received. The playing pieces are kept face down not shown to other players. Players should make the rule clear before game begins whether each player must put in a token chip for each game. The player forfeits the token chip if the player quits or folds before the round is completed.
3. After the first round of bet is settled, the dealer deals another playing piece to each remaining player. Then the second round betting takes place by the next player in sequence. Any player can raise the bet once in a round. This continues until each player has received all 5 playing pieces for 5 letter word poker, 7 playing pieces for 7 letter word poker, etc. Then the final round of betting takes place. When betting is settled or stopped after unlimited raises, players will show their hands and declare the highest score words that can be formed, for instance, out of their 5 playing-piece hands. The highest score winner wins the bets. The players should make the rule clear before game begins whether one must use all of the alphabets in one's hand to form a word or one can pick the highest score word by ignoring one or more letters. This rule can dictate the strategy of scrambling.
4. An alternative rule may be introduced by letting the game go on beyond 5 playing pieces. That is the dealer can continue dealing after 5 playing pieces are dealt and players can make corresponding betting. Any player can elect to show his or her hand during this extended dealing to declare a word. If the declared word is the highest score, then the declarer wins the bets; otherwise, the one with highest score wins. In counting the score, the long-word bonus points may be added to the word if it is equal or longer than 7 letters. For example, the bonus points are 10 points for 7 letter word, 20 for 8 letter word, 30 for 9 letter word, and so on.

The Scramble Ma-Jong

The Scramble Ma-Jong is also based on the concept of constantly and dynamically scrambling the alphabets to form words strategically in the process stimulating the players' brain activities. The game uses a set of alphabet playing pieces like the Scramble Word set with 136 playing pieces. The game is typically played by four people similar to a Ma-Jong game setting, however, more than four can play the Scrammble Ma-jong game. The object of the game is to score more points in each game and the final total score summing over all games determines the champion. Some of the Ma-Jong rules can be integrated in this game since many people are familiar with them.

In FIG. 5, a schematic game setting, 500, for Scramble Ma-Jong is shown. A game board is not necessary, however, one can be used over a card table or a Ma-Jong table for providing guidance. As shown, the game is set up for four people to play. Each player collects 17 pairs or 34 playing pieces to make a stack, 540, in front of the player. Upon determining who is the starter with a pair of dice, 161, the players take turn to collect four playing pieces at a time until each has 13 playing pieces except the starting player collects the 14th playing piece. The 13 playing pieces, 550, are hidden from other players' view, hence some players prefer to put them face down, exhibiting the backside of the playing pieces, for example, a Chinese King, 550.

In principle, more people can play simultaneously if an appropriate set of alphabets is used. A set of Scramble Word alphabets, like the set described above is used to illustrate the game. The set has a total of 136 playing pieces which match the number of tiles in a conventional Ma-Jong game. Thus all Ma-Jong players can adopt the Scramble Ma-Jong game easily. The seating arrangement in Scramble Ma-Jong can be critical since players play in sequence, hence a pair of dice is used to determine the seating arrangement, the starting point of tile distribution of playing pieces and who starts the game. A recording pad for keeping game score or a box of chips can be used for settling scores.

An exemplary play method of the Scramble Ma-Jong is illustrated below:

1. Four people play the game; 136 playing pieces are divided into 4 subsets 34 each as shown in FIG. 5. All players jointly shuffle the playing pieces and then collect them into a subset of 34 or 17 pairs stacked up in front of the players. Players can agree on any method to determine seating, sequence of picking up playing pieces and who will be the starter of the game.
2. As an example, each player draws a playing piece to determine the seating sequence, alphabetical sequence clockwise. Each player draws a letter again or throw dice to determine who starts the game. The starter then throws the pair of dice to determine in which position among 4 subsets and from which stacked subset, he or she begins to draw the playing pieces. The other players then follow the starter counter clockwise to draw the playing pieces but the play sequence is clockwise sequence. The starter draws 4 playing pieces at a time and others follow suit until each has 12 playing pieces. Then the starter will draw one more playing piece, $13^{th}$, and jump pick an extra playing piece, $14^{th}$, leaving three for the other three players to get their $13^{th}$ playing piece. The play method is similar for a 16-playing-piece Majong game, if the players choose to play 16-playing-piece Scramble Ma-Jong,
3. Winning a Scramble Ma-Jong game is called "Hu"; that is when one can form a set of patterns in 3, 3, 3, 3, and 2 symbols (this 2 pair is called Ma-Jong, the 3's are usually consecutive number sequence or three of a kind symbols). In the Scramble Word Ma-Jong, the winning pattern is a set of words which need not be the fixed combination of 3-3-3-3 and 2. It can be any of the 21 patterns shown below and in FIG. 6. Forming any of these word patterns require constantly and dynamically scrambling the alphabet playing pieces during the play. The word game characteristics will make the Scramble Ma-Jong game far more challenging and interesting than traditional Ma-Jong game which is keeping to a fixed combination pattern (3,3,3,3,2). One notes that in all these 21 patterns, there must be a pair, a word of two letters, serving as Ma-Jong pair. FIG. 6 shows the list of 21 patterns, 610, of Scrammble Ma-Jong. These 'Hu' patterns can be played simultaneously or selectively as per players agreement. For example, all players must compete to form words of the same pattern or each player can choose to form a different pattern. This variation makes the game very intriguing and competitive. The scoring system reflects the probability functions of each 'Hu' pattern. A few examples of 'Hu' patterns, 620, 630 and 640 are illustrated in FIG. 6. Playing the 'Hu' pattern just on the word level is challenging enough as one chooses to play the tough ones. For language specialists, they may add more restrictions such as the words formed must also make sense linguistically such as a sentence or phrase, as shown in FIG. 6, 620, or belong to the grouping, say medical terms, legal terms or animal names etc. Based on probability theory, bonus points are given to the tougher words and patterns. Players can adjust the bonus points according to their wishes and/or make the additional restrictions to make the game more challenging. For example, a sentence bonus of 50 points is shown in FIG. 1*d*.

The difficulty level of forming words in the twenty one possible patterns shown here, (1)2,3,4,5 (2)2,4,4,4 (3)2,2,4,6 (4)2,3,3,6 (5)2,2,5,5 (6)2,2,3,7 (7)2,2,3,3,4 (8)2,2,2,4,4 (9)2,2,2,3,5 (10)2,3,3,3,3 (11)2,5,7 (12)2,6,6 (13)2,2,2,2,6 (14)2,2,2,8 (15)2,4,8 (16)2,2,2,2,3,3 (17)2,2,2,2,2,4 (18)2,3,9 (19)2,2,10 (20)2,12 (21)2,2,2,2,2,2,2, is approximately ordered from (1) to (21), in increasing difficulty. It is rather simple to form four words of 2,3,4 and 5 letters long than to form seven 2 letter word out of 14 alphabet playing pieces. When wild playing pieces are included, the formation of the word combination pattern gets easier. Players must agree ahead of time whether any of the wild playing pieces should be included in the play or not. The mathematics is rather complicated in computing the precise probability value for the above 21 patterns. In addition, the probability function changes depending on what initial set of 13 playing pieces one gets and what playing pieces are discarded during the play. Figuring out qualitatively the probability of winning a given Scrammble Ma-Jong pattern ("Hu") as the game is played is the most challenging mathematical or logical problem. Therefore the ranking of the patterns is derived by approximation but not precisely. Similarly, the ranking patterns for the 16-playing-piece Scrammble Ma-Jong are derived as follows: (1)2,3,3,4,5 (2)2,3,4,4,4(3)2,3,3,3,3,3 (4)2,3,6,6 (5)2,3,5,7 (6)2,3,3,3,6 (7)2,4,5,6(8)2,4,4,7(9)2,3,4,8(10)2,3,3,9(11)2,5,5,5 (12)2,5,10(13)2,6,9(14)2,7,8 (15)2,4,11(16)2,3,12 (17)2,2,4,4,5(18)2,2,3,4,6 (19)2,2,3,5,5 (20)2,2,3,3,3,4 (21)2,2,6,7(22)2,2,5,8(23)2,2,4,9(24)2,2,3,3,7(25)2,2,3,10 (26)2,2,2,3,4,4 (27)2,2,2,3, 3,5(28)2,2,2,3,8(29)2,2,2,4,7(30)2,2,2,5,6(31)2,2,2,11 (32)2,2,2,2,3,6(33)2,2,2,2,4,5(34)2,2,2,2,3,3,3(35)2,2,2,2,9 (36)2,2,2,2,2,3,4 (37)2,2,2,2,2,7(38)2,2,2,2,2,2,5 (39)2,2,2,2,2,2,2,3 with increasing difficulty from (1) to (39). The Scrammble Ma-Jong based on constantly and dynamically scrambling the alphabets playing pieces adds language challenge to the mathematical and entertaining game. It stimulates the brain and yet is extremely entertaining.

4. The starter has a chance to "Hu" before game begins, that is called "Heaven Hu" or 'Virgin Hu'. The winner will be awarded 50 bonus points as shown in FIG. 1*d* plus the value points computed from the pattern. When the starter discard the first playing piece if any other player can make "hu" on that piece it is called "Earth Hu". The winner will be awarded 30 bonus points as shown in FIG. 1*d*. Barring a "Heaven Hu" or 'Earth Hu', each player will take turn to draw a playing piece and discard an unwanted piece to maintain 13 playing pieces in the hand. When opportunity presents, that is a letter needed to "Hu" shows up either as other player's most recently discarded piece or as one drawn from the playing piece stack, one can declare "Hu" and count one's winning score. A player can make a partial declaration by laying down a word face up by absorbing an alphabet playing piece just being discarded by the most recent player. This capture can interrupt the normal sequence of play. By doing scrambling constantly, players can keep interrupt and capture words to race to "Hu". The previously discarded playing piece can not be absorbed into the word formation or scramble process. The players continue the rounds until someone makes "Hu".

5. A player can recognize a new word by adding one or more alphabet playing piece to his or her words previously laid down as a partial winning, if this Scramble would increase the total value points for "Hu". The new word of course must be longer than the original word with letters 'Scrambled', hence it can add more value points so long it still fits in the required 'Hu' pattern. However, in a Free Form Scramble Ma-Jong game, it is more strategic to recognize the total pattern value which adds all bonus points including, the pattern bonus, for example, 10 points multiplied by the pattern number. Therefore by Scrambling words, say one can move the pattern from (1) to (6), the player can get 50 bonus points more by claiming "Hu" according to pattern (6) rather than pattern (1). By agreement in advance among players, rules may be added to forbid adding a letter 's' or 'd' or 'ed', 'n' or 'en' to a word to lay down partial winning since a new word is not produced by a plurality change or tense change. By agreement, any game can be fixed to play with a fixed pattern, for example as determined by drawing randomly from the deck of rules and instructions. For example, if pattern (15) is drawn to be the playing pattern (2,4,8) for a game, then all players must compete to 'hu' by pattern (2,4.8), hence must be strategic about scrambling and capturing words to lay down as partial winnings. One must not jeopardize the chance of forming the "Hu" pattern that is pre-selected or drawn. Bonus points can be modified per players' agreement for any "Hu" pattern especially when more wild cards are included into the game.

6. The game continues until all playing pieces have been used up and discarded on the board. Before a player draws the last playing piece, the player has the option to declare the game as a stalemate (no one wins) or he can draw and play to win. If he plays to win and can not "Hu" or win then he must discard a playing piece. If someone else made "Hu" on that discarded playing piece, a penalty of 20 points may be taken off the score sheet of the player who let someone to win on the last discarded playing piece. The player won on the last discarded playing piece gets a bonus of 20 points.

7. The score is tabulated by adding the value points of every word won plus any bonus points entitled. The point counting can follow the Scrammble Word example as described before and shown in FIG. 1*d*, however, by agreement, the players must decide how many wild playing pieces will be included and whether or not other modification on the math functions or bonus rules will be added. Penalties must be recorded whenever they occurred. Alternatively, the score can be settled by the winner collecting chips from the losers according to the points won. Since the "Hu" pattern (18), (19), (20) and (21) are very difficult to achieve, their bonus points are doubled. That is for winning pattern (18), the bonus is 360 points rather than 180 points. These general rules of Scrammble Ma-Jong can be printed on the deck of rules as the playing guide.

8. Variation of Play: the (1) to (21) 'Hu' patterns can be printed on paper cards as part of the deck of rules and instructions. Players can throw dice to elect one player to draw a pattern for the game. Once the pattern is determined in each game, every player must 'Hu' by the same pattern rather than making individual choice which is called Free Form 'Hu'.

Scrammble Games

We define Scrammble Games as word games based on the 'word scramble process', constantly and dynamically scrambling words, and the 'Scrammble Set', a unique set of playing pieces which contains alphabets and symbols of a language ranked in a specific 'order' with a specific 'distribution ranking' and contains value points and math functions operable on the adjacent and/or all playing pieces in a formed word in a specific manner. The math functions capable of operating on the adjacent and/or all playing piece which are assigned lower or higher value points. They have more or less duplicate pieces all according to their higher or lower frequency of occurrence in vocabulary. These features make the 'word scramble process' and the 'Scrammble Set' as unique properties for creating interesting and challenging word games which we called Scrammble Games.

The Scrammble Word, the Scrammble Poker and the Scrammble Ma-jong games described above are clear examples of Scrammble Games. The inventor has created many other Scrammble Games based on the above described unique properties. For example, the Scrammble Crossword is a variation to let players to play Scrammble Word by placing words formed in a Crossword pattern, that is words can be extended horizontally or vertically from any playing piece of an already formed word so long the extension branch will make a meaningful word. Adding a new feature of being able to steal any branch in a Scrammble Crossword makes full use of the 'word scramble process' and the features of the 'Scrammble Set'. So Scrammble Crossword has the above described unique properties thus is one of the Scrammble Games.

Another example is the Scrammble Bingo which integrates the Bingo Card concept by adding a learning feature based on vocabulary Bingo rather than the conventional numerical Bingo. The Scrammble Bingo card, 701, is shown in FIG. 7, where its cells are characterized by rows and columns with a vowel designation. For example, if I, * (represent a wild playing piece), E, O, and U are placed in the diagonal cells of a 5 by 5 Scrammble Bingo card, 701, shown in FIG. 7. The first row and first column are defined as 'a' row and 'a' column. The center row and center column in this card are 'e' row and 'e' column. When the alphabet playing pieces are opened one by one in sequence by a Bingo dealer, players are supposed to form words and place them in the right vowel-designated row or column, that is the word must contain the same vowel to be placed in that vowel-designated cell. In this game, each alphabet playing piece dealt can only be used once in forming words except when a longer word is made by absorbing all the playing pieces of an already formed shorter word. Then the alphabets of the shorter word can be scrambled into a longer word and still be counted as being used once. This feature again makes full use of the unique properties created by the 'word scramble process' and the 'Scrammble Set'. As a simple illustration, say the Scrammble Bingo pattern to be filled is a vertical line of five cells, 702, if letters e, b, q, t, d, r, a, c, k were dealt open in sequence, one player may have declared: be, bet, debt, and bated then placed them on his Scrammble Bingo card. Another player may have declared: be, bed, bred, bread, and have two choices, braced or braked to form the vertical pattern, 702, as shown in FIG. 7, a Bingo of five words (all containing e) placed in a column designated by vowel e. In this example, the first player was leading and would have won if different letters such as u and s came along to allow him to make 'tubed' and 'busted' to form a Bingo. It is clear that Scrammble Bingo exhibits the above described unique properties hence it is another Scrammble Game. Similarly, Scrammble Hangman, Scrammble Bridge, Scrammble Solitaire and Scrammble War are also created based on the above described unique properties as a word game belonging to the class of Scrammble Games.

The above descriptions are merely examples and instances used for illustrative purposes. For those skilled in the art, it is clear that many examples and scenarios can be implemented based on the 'word scramble process' and the unique 'Scrammble Set' or the playing pieces disclosed in the present invention. The specific terms such as Scrammble Bingo, Scramble Word, Scramble Poker and Scramble Ma-Jong are used to give players an association with a familiar existing game such as Bingo, Poker and Ma-Jong. The present invention discloses a game system with unique properties capable of playing multiple word games in tile game, board game, card game, computer game and interactive TV game format all characterized as Scrammble Games. The present invention integrates language, logic and mathematics intricacies together to make a unique set of word games not only enjoyable for entertainment but also challenging and useful for learning and stimulating brain activities to help people maintain their physical and mental health.

What is claimed is:

1. A word game system for playing a multiple word games comprising of a word game set of playing pieces suitable for handling in word game playing in a form such as card, tablet and tile, containing three types of playing pieces with the following markings to facilitate word game playing:

(1) type one playing pieces having (i) markings chosen from the language symbols including alphabets of a language rendering said playing pieces as alphabet playing pieces representing said chosen alphabets and language symbols of a language and (ii) markings representing value points assigned to said alphabet playing pieces with numerical values being inversely proportional to the distribution ranking of said alphabet playing pieces;

(2) type two playing pieces having (i) markings chosen from the language symbols including alphabets of a language rendering said playing pieces as alphabet playing pieces representing said chosen alphabets and language symbols of a language, (ii) markings representing value points assigned to said alphabet playing pieces with numerical values being inversely proportional to the distribution ranking of said alphabet playing pieces, and (iii) markings representing mathematical functions assigned to said type two alphabet playing pieces with said mathematical functions being math operators operable on said value points of any adjacent and remote alphabet playing pieces contained in a word formed by said alphabet playing pieces to produce bonus points and a word point score; and (3) type three playing pieces having (i) markings capable of representing the language symbols including alphabets of a language rendering said playing pieces as wild alphabet playing pieces representing any alphabet and language symbol of a language, (ii) markings representing value points assigned to said alphabet playing pieces with numerical values, and (iii) markings representing mathematical functions assigned to said wild alphabet playing pieces with said mathematical functions being math operators operable on said value points of any adjacent and remote alphabet playing pieces contained in a word formed by said alphabet playing pieces to produce bonus points and a word point score;

wherein said word game set of playing pieces having multiple number of playing pieces for each said type of playing pieces rendering said word game set a game apparatus for playing word games;

wherein said markings on said each type of playing pieces facilitate the playing of said word game set of playing pieces to perform adding and scrambling any of said three types of playing pieces to form words, to obtain bonus points and to score total word points based on vocabulary and math skills.

2. In claim 1 said word game system comprising of an English word game set of playing pieces suitable for handling in word game playing in a form such as card, tablet and tile, containing three types of English playing pieces with the following markings to facilitate word game playing:

(1) type one playing pieces having (i) markings chosen from the language symbols including alphabets of the English language rendering said playing pieces as English alphabet playing pieces representing said chosen alphabets and language symbols of the English language and (ii) markings representing value points assigned to said alphabet playing pieces with numerical values being inversely proportional to the distribution ranking of said English alphabet playing pieces;

(2) type two playing pieces having (i) markings chosen from the language symbols including alphabets of the English language rendering said playing pieces as English alphabet playing pieces representing said chosen alphabets and language symbols of the English language, (ii) markings representing value points assigned to said alphabet playing pieces with numerical values being inversely proportional to the distribution ranking of said English alphabet playing pieces, and (iii) markings representing mathematical functions assigned to said type two English alphabet playing pieces with said mathematical functions being math operators operable on said value points of any adjacent and remote English alphabet playing pieces contained in an English word formed by said English alphabet playing pieces to produce bonus points and a word point score; and (3) type three playing pieces having (i) markings capable of representing the language symbols including alphabets of the English language rendering said playing pieces as wild English alphabet playing pieces representing any alphabet and language symbol of the English language, (ii) markings representing value points assigned to said wild English alphabet playing pieces with numerical values, and (iii) markings representing mathematical functions assigned to said wild English alphabet playing pieces with said mathematical functions being math operators operable on said value points of any adjacent and remote English alphabet playing pieces contained in an English word formed by said English alphabet playing pieces to produce bonus points and a word point score;

wherein said word game set of playing pieces having multiple number of playing pieces for each said type of playing pieces rendering said word game set a game apparatus for playing English word games;

wherein said markings on said each type of playing pieces facilitate the playing of said word game set of playing pieces to perform adding and scrambling any of said three types of playing pieces to form English words, to obtain bonus points and to score total word points based on vocabulary and math skills.

3. In claim 1 said game set contains 136 playing pieces wherein 112 of said playing pieces are said type one alphabet playing pieces with said markings of alphabet and language symbol and value point;

wherein 20 of said playing pieces are said type two alphabet playing pieces with said markings of alphabet and language symbol, value point and mathematic function; and wherein 4 of said playing pieces are said type three wild playing pieces with said markings of wild symbol signifying that said wild playing pieces can be designated as any alphabet playing pieces with said markings of value points and mathematic function.

4. In claim 1 said game set containing 136 English alphabet playing pieces;

wherein the distribution number of the said English alphabet playing pieces are a(10), b(2), c(4), d(6), e(15), f(4), g(3), h(7), i(8), j(1), k(1), l(6), m(4), n(10), o(9), p(3), q(1), r(8), s(7), t(11), u(4), v(1), w(2), x(1), y(3), and z(1) plus wild (4); wherein the numerals designate the number of said English alphabet playing pieces in said game set;

wherein the value points of said English alphabet playing pieces are:

a(1), b(7), c(4), d(3), e(1), f(5), g(6), h(2), i(2), j(11), k(9), l(3), m(5), n(1), o(1), p(6), q(12), r(2), s(2), t(1), u(4), v(8), w(7), x(10), y(6), and z(13) plus wild (0); wherein the numerals designate the value points of said English alphabet playing pieces;

wherein the math functions marked on said English alphabet playing pieces are any arithmetic and algebraic function; and wherein said type two and type three playing pieces selected for having the math functions represent English vowels and wilds respectively.

5. In claim 1 said word game system comprising of a non-English alphabetic word game set of playing pieces suitable for handling in word game playing in a form such as card, tablet and tile, containing three types of playing pieces each with the following markings to facilitate word game playing:

(1) type one playing pieces having (i) markings chosen from the language symbols including alphabets of a non-English alphabetic language rendering said playing pieces as non-English alphabet playing pieces representing alphabets and language symbols of a non-English alphabetic language and (ii) markings representing value points assigned to said non-English alphabet playing pieces with numerical values being inversely proportional to the distribution ranking of said non-English alphabet playing pieces;

(2) type two playing pieces having (i) markings chosen from the language symbols including alphabets of a non-English alphabetic language rendering said playing pieces as non-English alphabet playing pieces representing alphabets and language symbols of a non-English alphabetic language, (ii) markings representing value points assigned to said non-English alphabet playing pieces with numerical values being inversely proportional to the distribution ranking of said non-English alphabet playing pieces, and (iii) markings representing mathematical functions assigned to said type two non-English alphabet playing pieces with said mathematical functions being math operators operable on said value points of any adjacent and remote non-English alphabet playing pieces contained in a non-English alphabetic word formed by said non-English alphabet playing pieces to produce bonus points and a word point score; and (3) type three playing pieces having (i) markings capable of representing the language symbols including alphabets of a non-English alphabetic language rendering said playing pieces as wild non-English alphabet playing pieces representing any alphabet and language symbol of a non-English alphabetic language, (ii) markings representing value points assigned to said non-English alphabet playing pieces with numerical values, and (iii) markings representing mathematical functions assigned to said wild non-English alphabet playing pieces with said mathematical functions being math operators operable on said value points of any adjacent and remote non-English alphabet playing pieces contained in a non-English alphabetic word formed by said non-English alphabet playing pieces to produce bonus points and a word point score;

wherein said word game set of playing pieces having multiple number of playing pieces for each said type of playing pieces rendering said word game set a game apparatus for playing non-English alphabetic word games;

wherein said markings on said each type of playing pieces facilitate the playing of said word game set of playing pieces to perform adding and scrambling any of said three types of playing pieces to form non-English alphabetic words, to obtain bonus points and to score total word points based on vocabulary and math skills.

6. In claim 1 said alphabet playing pieces in said word game set representing a non-alphabetical language and words therein via alphabet symbol representation rendering non-alphabetical language words playable like alphabetic language words;

wherein said alphabet playing pieces with alphabet language symbol markings used in combination represent said non-alphabetic words in a non-alphabetic language;

wherein said markings facilitate the playing of said word game to perform adding and scrambling any of said three types of playing pieces to form representation of non-alphabetic words, to obtain bonus points and to score total word points based on vocabulary and math skills;

and wherein said alphabet symbol representation represents phonics and images of said non-alphabetic words in said non-alphabetical language such as Chinese, Japanese and Korean.

7. In claim 1, wherein said markings on said each type of playing pieces facilitate the playing of said word game set of playing pieces to perform adding and scrambling any of said three types of playing pieces to form words, to obtain bonus points and to score total word points based on vocabulary and math skills and wherein said markings of language symbols, value points and math operators on said each type of playing pieces are located on the surface of the playing pieces to make said word game set playable as Scrammble Word by using Scrammble Word game rules comprising:

(1) dealing and revealing the playing pieces continuously for all players to see, (2) monitoring all players to form words simultaneously and continuously against time at the same time by racing to take some of the continuously revealed playing pieces ('word scramble process') to form words and to take possession of said formed words before other players accomplishing the same, (3) tracking all players to play simultaneously using only the revealed playing pieces without auxiliary aids to scramble said revealed playing pieces included in any already formed word and to add additional said revealed playing pieces not contained in any already formed word to extend said already formed word to a new and longer word and to take possession of said new and longer word all against time at the same time ('word scramble process'), preventing other players accomplishing the same, (4) permitting all players to cumulate words continuously against time at the same time to form new words, extend owned words, and steal as many words from other players via the word scramble process and then compare in total word score by letting each player sum over all value points in each player's said possessed words and letting each player add bonus points produced by performing said math functions marked on said playing pieces in each player's said possessed words over the adjacent and remote playing pieces in each player's said possessed words, and (5) declaring the player with the highest total word score as the winner.

8. In claim 1, wherein said markings on said each type of playing pieces facilitate the playing of said word game set of playing pieces to perform adding and scrambling any of said three types of playing pieces to form words, to obtain bonus points and to score total word points based on vocabulary and math skills and wherein said playing pieces taking a rectangular shape with said markings of language symbols, value points and math operators on said each type of playing pieces locating at the center of the playing pieces to make said word game set playable as Scrammble Majong using conventional Majong game rules and by using said playing pieces to replace conventional Majong tiles comprising:

adopting the conventional Ma-Jong game procedure and game rules to said game set of alphabet playing pieces making said game set playable as Scrammble Ma-Jong, a word game with Ma-Jong procedures and rules, wherein a player can declare a win after accomplishing a 'Hu Pattern' by using up all dealt playing pieces plus one additional playing piece and wherein said Scrammble Ma-Jong game 'Hu'-patterns' are specifically defined differently by expanding the conventional 'Hu pattern' (2,3,3,3,3) for the conventional 13-piece Ma-Jong game to 21 Scrammble Ma-Jong 'Hu patterns' and expanding the conventional 'Hu pattern' (2,3,3,3,3,3) for the conventional 16-piece Ma-Jong game to 39 Scrammble Ma-Jong 'Hu patterns', wherein said 21 'Hu' patterns are (1)2,3,4,5 (2)2,4,4,4 (3)2,2,4,6 (4)2,3,3,6 (5)2,2,5,5 (6)2,2,3,7 (7)2,2,3,3,4 (8)2,2,2,4,4 (9)2,2,2,3,5 (10)2,3,3,3,3 (11)2,5,7 (12)2,6,6 (13)2,2,2,2,6 (14)2,2,2,8 (15)2,4,8 (16)2,2,2,2,3,3 (17)2,2,2,2,2,4 (18)2,3,9 (19)2,2,10 (20)2,12 (21)2,2,2,2,2,2,2 for 13-piece Scrammble Ma-Jong game; and said 39 'Hu' patterns are (1)2,3,3,4,5 (2)2,3,4,4,4 (3)2,3,3,3,3,3 (4)2,3,6,6 (5)2,3,5,7 (6)2,3,3,3,6 (7)2,4,5,6 (8)2,4,4,7 (9)2,3,4,8 (10)2,3,3,9 (11)2,5,5,5 (12)2,5,10 (13)2,6,9 (14)2,7,8 (15)2,4,11 (16)2,3,12 (17)2,2,4,4,5 (18)2,2,3,4,6 (19)2,2,3,5,5 (20)2,2,3,3,3,4 (21)2,2,6,7 (22)2,2,5,8 (23)2,2,4,9 (24)2,2,3,3,7 (25)2,2,3,10 (26)2,2,2,3,4,4 (27)2,2,2,3, 3,5 (28)2,2,2,3,8 (29)2,2,2,4,7 (30)2,2,2,5,6 (31)2,2,2,11 (32)2,2,2,2,3,6 (33)2,2,2,2,4,5 (34)2,2,2,2,3,3,3 (35)2,2,2,2,9 (36)2,2,2,2,2,3,4 (37)2,2,2,2,2,7 (38)2,2,2,2,2,2,5 (39)2,2,2,2,2,2,2,3 for 16-piece Scrammble Ma-Jong game.

9. In claim 1, wherein said markings on said each type of playing pieces facilitate the playing of said word game set of playing pieces to perform adding and scrambling any of said three types of playing pieces to form words, to obtain bonus points and to score total word points based on vocabulary and math skills and wherein said playing pieces taking a rectangular shape with said markings of language symbols, value points and math operators on said each type of playing pieces locating at the upper left corner and the center of the playing pieces to make said word game set playable as Scrammble Poker using conventional Poker game rules and by using said playing pieces to replace conventional Poker cards.

10. In claim 1, wherein said markings on said each type of playing pieces facilitate the playing of said word game set of playing pieces to perform adding and scrambling any of said three types of playing pieces to form words, to obtain bonus points and to score total word points based on vocabulary and math skills and wherein said markings of language symbols, value points and math operators on said each type of playing pieces are located at the center of the playing pieces to make said word game set playable as Scrammble Bingo using conventional Bingo game rules, by using said playing pieces to replace conventional Bingo chips and by using a Scrammble Bingo boards comprising:

(i) Scrammble Bingo boards having twenty five cells arranged in 5 by 5 square;

wherein along one of its two diagonal, five of the six symbols, a, e, i, o, u and a wild symbol, such as *, #, and !, one of any commonly used symbols, signifying five vowels and a wild, are marked to characterize the rows and columns by said symbols, wherein only words containing said vowel symbol are allowed to be placed in a cell characterized by the same said vowel symbol, and wherein the wild symbol can be viewed as any of the five vowels to characterize the row and the column if placed in a diagonal cell of said Scrammble Bingo board, (ii) adopting a set of playable Scrammble Bingo patterns for said Scrammble Bingo game comprising single horizontal line, single vertical line, a double line, a cross, a diagonal cross, a, diamond, a hollow square, a solid square, and several patterns in letter shapes including E, F, H, I, K, L, M, N, T, U, V, W, X, Y and Z; and an additional Scrammble Bingo rule for allowing said playing pieces, in a formed word already placed on said Scrammble Bingo board, to be scrambled and added with additional available playing piece to form a new and longer word, and to place said longer word in an allowed cell of a selected playable said Scrammble Bingo pattern, and (iii) having multiple Scrammble Bingo boards with premarked diagonal cells with vowels and wild for players to select and exchange to start a new Scrammble Bingo game;

wherein each dealer announced alphabet playing pieces for Scrammble Bingo game can be used only once to form a word to be placed in a permitted cell on said Scrammble Bingo board; and wherein when said dealer announced alphabet playing pieces for Scrammble Bingo game are used in a word and placed in a cell, said used alphabet playing pieces can be reused with additional alphabet playing pieces to form a new and longer word using all of the alphabet playing pieces of said earlier and shorter word formed.

11. In claim 10, said language is one of the following languages: English and non-English such as French, German, Italian, Russian, Arabic, Spanish, Chinese, Japanese and Korean.

12. In claim 1, said set of playing pieces with said markings are generated by computer graphics displayable on computer monitor and TV monitor rendering said game set a virtual game set suitable for playing in the computer and TV media with said playing pieces in graphics form being controlled and displayed by a computer program running in a computer, wherein said playing pieces are controlled by one of multiple interface devices;

wherein said one interface device is any one of the following computer input device, mouse, keyboard, track ball and joystick for operating said playing pieces in a computer;

wherein said another interface device is a separate computer with any one of the following computer input device, mouse, keyboard, track ball and joystick for operating said playing pieces over a computer network such as Internet, and wherein said another interface device is a TV remote control operating on said playing pieces over an interactive TV network.

* * * * *